United States Patent [19]

Sevelinge

[11] Patent Number: 4,738,403

[45] Date of Patent: Apr. 19, 1988

[54] WHEEL FOR A VACUUM PROJECTION GRINDER

[75] Inventor: Gérard Sevelinge, Montceau les Mines, France

[73] Assignee: Framatome, Courbevoie, France

[21] Appl. No.: 13,086

[22] Filed: Feb. 10, 1987

[30] Foreign Application Priority Data

Feb. 10, 1986 [FR] France ..... 86 01774

[51] Int. Cl.[4] ..... B02C 19/00

[52] U.S. Cl. ..... 241/275

[58] Field of Search ..... 241/275, 5, 300, 40; 198/641, 642

[56] References Cited

U.S. PATENT DOCUMENTS

| | | | |
|---|---|---|---|
| 3,174,697 | 3/1965 | Bridgewater . | |
| 3,970,257 | 7/1976 | MacDonald et al. | 241/275 |
| 4,682,739 | 7/1987 | Sevelinge | 241/275 |

FOREIGN PATENT DOCUMENTS

| | | | |
|---|---|---|---|
| 2201928 | 5/1974 | France . | |
| 2283726 | 4/1976 | France | 241/275 |
| 2412348 | 7/1979 | France . | |

OTHER PUBLICATIONS

European Patent Application, 0101277, 2-1984.

*Primary Examiner*—Mark Rosenbaum

*Attorney, Agent, or Firm*—Pollock, Vande Sande & Priddy

[57] ABSTRACT

A distributor wheel 20 comprises, downstream of each outlet aperture (24, 25) of its channels (22, 23), in relation to the direction of the projection of particles, a member (30, 33, 34) fixed for rotation with the wheel (20) and making it possible to form, at the end of the guide face of each channel (22, 23), a stable protective cushion composed of the particles themselves and extending the stable self-protection layer (28), and to eliminate the contact force between the particles and the wheel (20) before ejection and projection of the particles onto the target.

13 Claims, 5 Drawing Sheets

WHEEL FOR A VACUUM PROJECTION GRINDER

FIELD OF THE INVENTION

The present invention relates to a wheel for a vacuum projection grinder in which the particles to be ground are projected by centrifugal force onto an impact surface disposed inside a vessel under vacuum.

BACKGROUND OF THE INVENTION

It is known that this type of grinder makes use of centrifugal force to project materials which are to be ground onto targets at very high speeds, the whole arrangement being disposed in a vacuum in order to avoid the braking of the particles through air resistance.

A vacuum grinder comprises a closed pressureresistant vessel which is under vacuum and at the top of which a distributor wheel rotated at high speed is disposed. The wheel is provided in its axis with a central feed chamber provided at the top with an axial aperture disposed at the bottom of a hopper fed with material to be ground by means of a metering device, for example of the screw type, disposed at the outlet of a feed chamber forming an air lock and enabling the material to be introduced into the vacuum vessel.

The distributor wheel is also provided with a plurality of projection channels whose axes are centered in a median plane at right angles to the axis and lead in the inward direction into the feed chamber and in the outward direction onto the periphery of the wheel.

The material introduced by the metering device into the central feed chamber is thus entrained by centrifugal force into the channels and projected, at the outlet of the latter, onto an assembly of plates forming targets and disposed all around the wheel, along the side wall of the vessel. The bottom part of the latter is in the form of a hopper and collects the fine powder formed by the bursting of the grains of material thus thrown onto the targets through the channels in the wheel.

If the distributor wheel rotates at a sufficiently high speed, a radial, tangential acceleration is thus created inside the channels and enables the desired speed to be obtained at the outlet. Inside these channels there is produced an effect of contact between the particles and the wheel in dependence on the speed of rotation, so that considerable wear ensues. This abrasive action depends on the physical properties of the particles, but is always very considerable as soon as the ejection speed itself becomes substantial, in view of the high value of the effect of contact between the particles and the wheel and the relative speed of displacement of the particles in the channels.

In order to protect these channels, French patent application No. 85-02234 in the name of the applicant discloses a distributor wheel in which the particle guide face in each channel has a positive curve, i.e. a curve winding in the direction of rotation of the distributor wheel and having a contour, judiciously calculated in accordance with the coefficients of friction of the materials in contact, which effects the attachment to this curve of a stable selfprotection layer consisting of the particles themselves, with automatic regeneration of this layer simultaneously with the wear to which it is subjected.

Because of the formation of the channels, in this arrangement the support faces of the particles formed by the bottom of the channels are therefore protected by a layer of particles, but the end point of the bottom of these channels, which is situated at the ejection aperture, is a vulnerable point which should also be protected.

Furthermore, the displacement of the particles to be ground from the center to the periphery of the distributor wheel takes place at a certain speed, which cannot be eliminated without bringing the output of the apparatus to zero.

This end point can be protected by forming a slope with the aid of appropriate shapes of the distributor wheel. It is now known that at its intersection with the laying plane a conical slope has zero thickness, and this also constitutes a vulnerable point where wear may occur. This solution consequently cannot be adopted.

In order to eliminate wear on the distributor wheel and to achieve effective protection at the ejection aperture of the distribution channels, it is therefore necessary either to ensure that the particles move over slopes whose thickness is not zero, or to ensure that the contact force between the particles and the slope is zero, particularly when the thickness of the slopes is almost zero.

SUMMARY OF THE INVENTION

The invention therefore has as its object a new form of construction of a grinder wheel enabling these disadvantages to be overcome.

According to the invention the distributor wheel has, downstream of each outlet aperture of the channels (with reference to the direction of projection of the particles), a member fixed for rotation with said wheel and making it possible to create, at the end of the guide face of each channel, a protective cushion composed of the particles themselves and extending the stable self-protection layer formed inside each channel, and to eliminate the contact force between the particles and the wheel before the ejection and projection of said particles onto the target.

According to another characteristic of the invention, the member disposed downstream of each outlet aperture of the channels is composed of a blade disposed at right angles to the plane of the wheel and provided with means effecting, beyond the end of the guide face of each channel, the formation of slopes whose geometry and inclination are determined in dependence on the coefficient of friction of the materials in contact and on the particle size of the material being treated.

The invention will be more clearly understood on perusal of the following description of one embodiment and on referring to the accompanying drawings, in which.

DESCRIPTION OF PREFERRED EMBODIMENT

Figure 1:
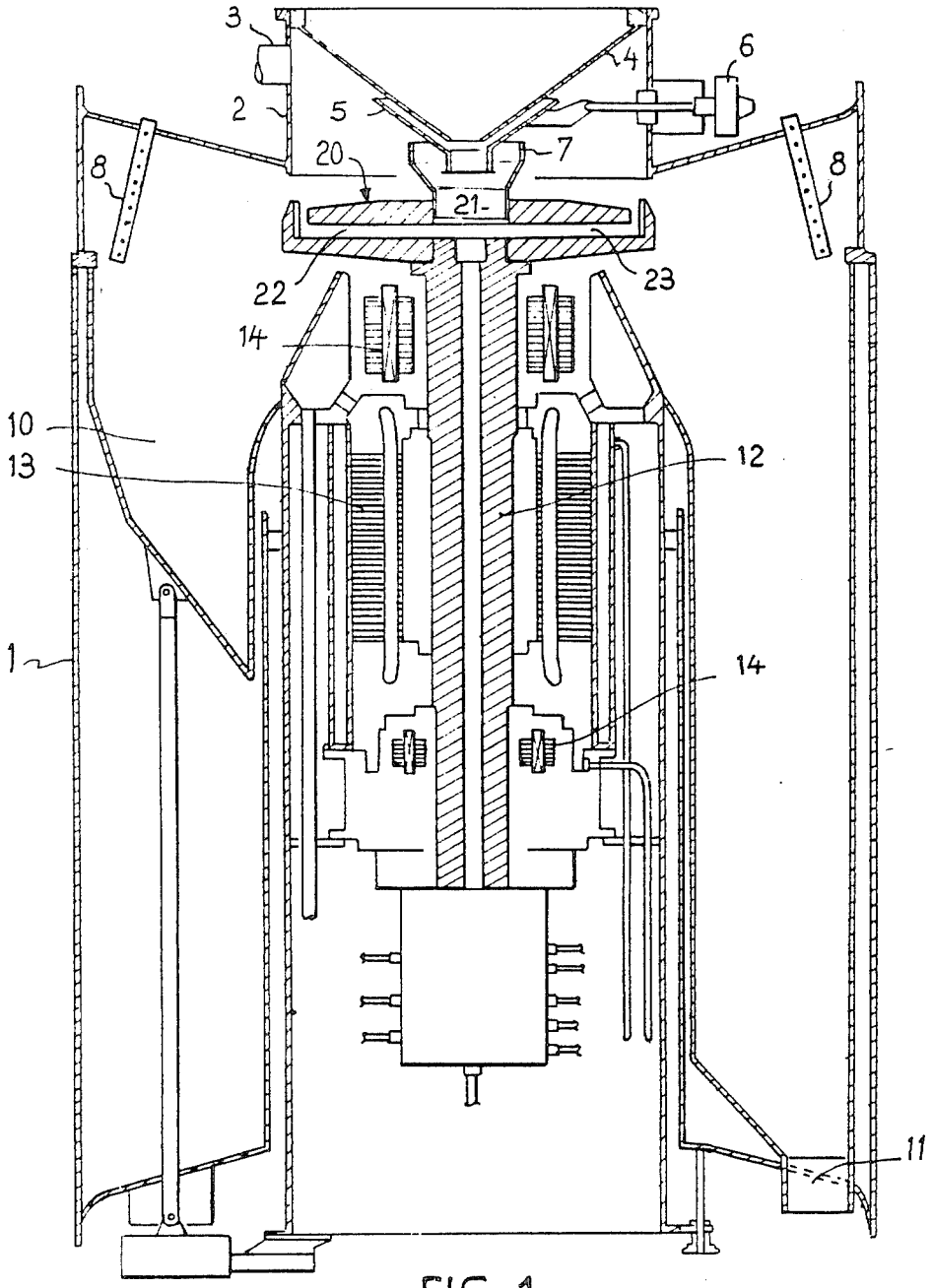
FIG. 1 is a schematic view in section in a vertical plane of the entire grinder utilizing a distributor wheel according to the invention.

FIG. 1 shows a cylindrical vessel 1 which has a vertical axis and at the top of which is disposed a vertical duct 2 of large section, which has a branch to which is fixed a pipe 3 connected to a vacuum pump (not shown). Hoppers 4 and 5 are disposed inside the duct 2. The hopper 5 is connected to a vibrator 6.

Below the vibrating hopper 5 is disposed a hopper 7 which is fed with material to be ground and whose axial outlet aperture discharges into a central feed chamber 21 of a distributor wheel 20 constituting the top part of the rotor of the grinder. A plurality of regularly distributed radially directed channels, such as 22 and 23, are formed in this wheel.

A target 8, whose impact surface is covered with a material resisting wear and impact, is disposed in line with said channels, all around the vessel.

Between the external peripheral surface of the wheel 20 and the target 8 a spatial zone can be determined, into which the particles to be ground will be projected. Below this spatial zone is disposed a vibrating hopper 10, the purpose of which is to collect the ground pulverulent material, in order to direct it to the outlet 11, which is connected to a set of air locks under vacuum which enable the product to flow off without destroying the vacuum in the vessel.

The wheel 20 constituting the top part of the grinder rotor is fixed for rotation with an elongated tubular cylindrical shaft 12. This shaft 12, which is driven by a motor 13, is guided and supported by an assembly of bearings and thrust bearings 14.

The motor 13 enables the wheel 20 to be rotated at very high speeds.

Figure 2:
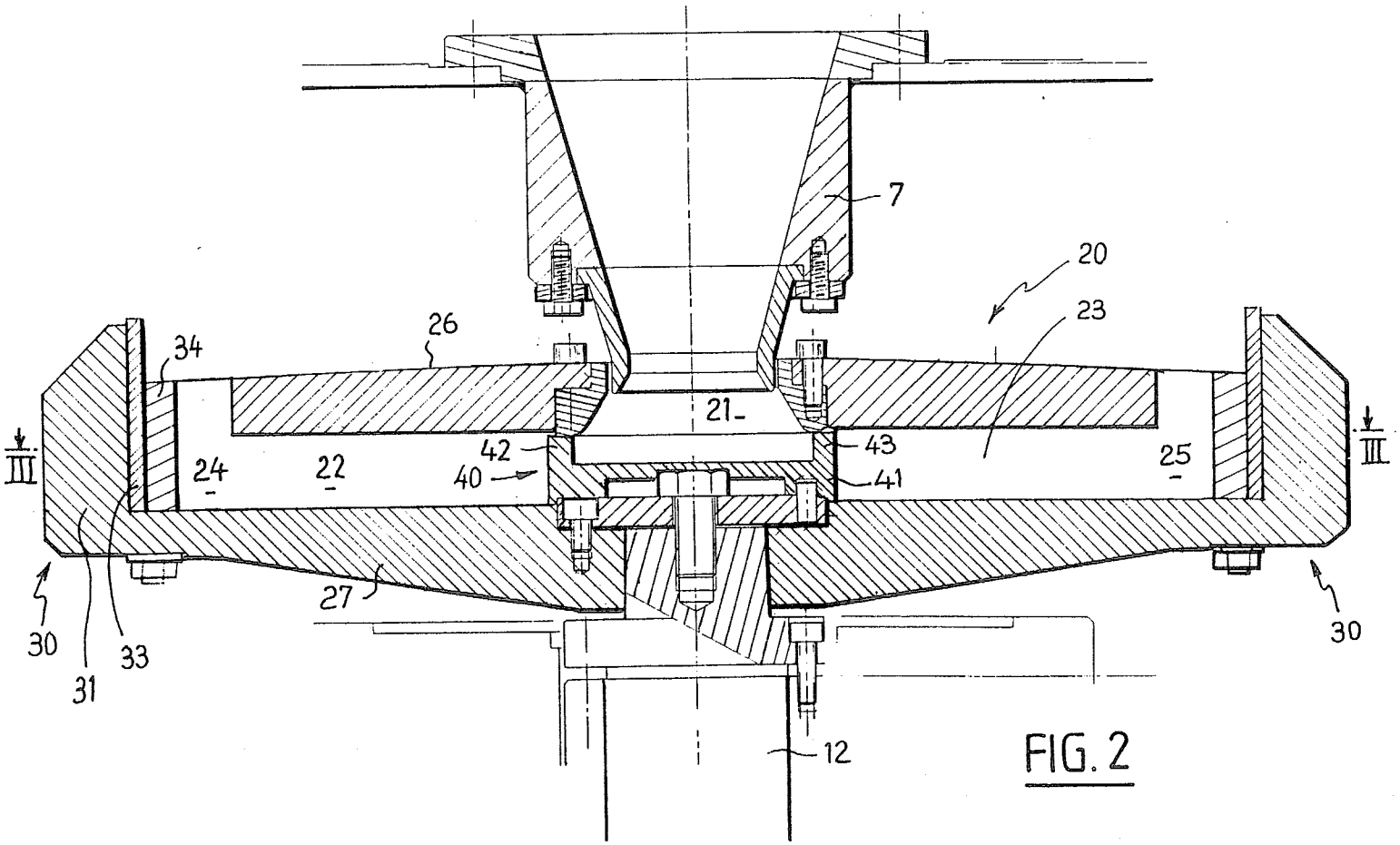
FIG. 2 is a view in section in a vertical plane, on a larger scale, of the distributor wheel according to the invention.

In FIG. 2 the distributor wheel 20 is shown on a larger scale, the interior of this wheel containing a feed chamber 21 and two channels 22 and 23 leading at their ends into the feed chamber 21 in the inward direction, and onto the periphery of the wheel via discharge apertures 24 and 25 in the outward direction.

The hopper 7 is disposed on the axis of the distributor wheel 20 and leads into the feed chamber 21 of said wheel. This distributor wheel 20 is composed of a cover 26 and a bottom 27 in the form of a circular plate, these two members being fastened to one another and driven rotationally at very high speeds by the shaft 12.

The material in grain form enters the feed chamber 21 and is thrown outwards by centrifugal force, passing through the channels 22 and 23. The particles thus thrown out through the channels impinge on the target 8 and are reduced to a fine powder.

The granular materials, for example cement or pulverized coal, treated in centrifugal grinders being fairly abrasive, fairly rapid wear is found on the inner side wall of the projection channels in the grinder, as well as on the ends of the channels, at the peripheral outlet aperture.

Figure 5:
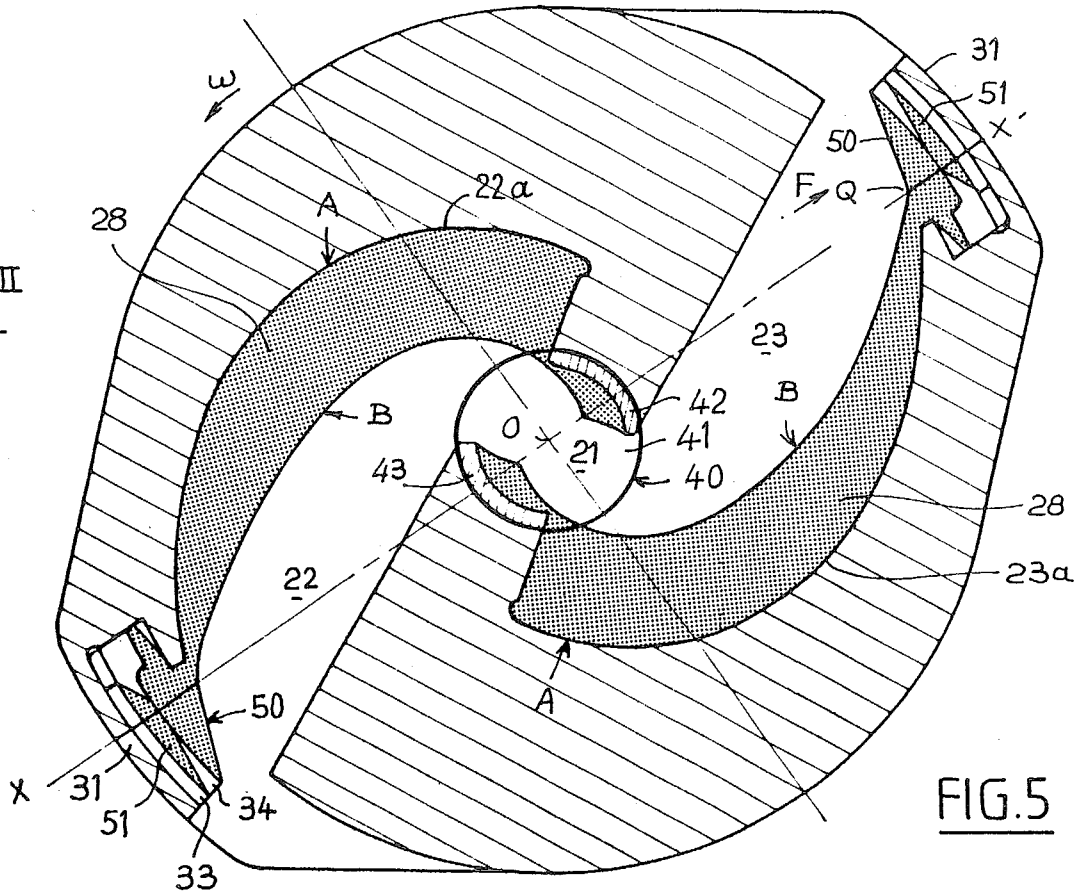
FIG. 5 is a view identical to FIG. 3, showing the formation of self-protection layers in the distributor wheel during the operation of the grinder.

In order to avoid wear on the inner side wall of the channels 22 and 23, the guide faces 22*a* and 23*a* for the particles in the respective channel have a positive curve A (FIG. 3), i.e., a curve winding in the direction of rotation of the distributor wheel 20, and having a contour judiciously calculated in accordance with the coefficients of friction of the materials in contact and effecting the attachment to said curve A of a stable self-protection layer 28 (FIG. 5) composed of the particles themselves, with automatic regeneration of said layer simultaneously with the wear to which it is subjected.

Thus, because of the shape of the particle guide faces 22*a* and 23*a*, a heap 28 of particles is formed in each of the channels 22 and 23 until this heap forms a curve B in such a manner that this fixed layer of particles constitutes veritable protection for said guide faces.

However, this self-protection layer 28 has practically zero thickness at the end 22*b*, 23*b* of each channel, so that this end constitutes a vulnerable zone subjected to considerable wear.

The invention makes it possible to avoid this wear process in this zone.

For this purpose, the distributor wheel 20 is provided at the end of each channel 22 and 23, at the outlet apertures 24 and 25, with a member given the general reference 30.

This member 30 is composed of a blade fastened to the wheel 20 or integral with it.

In the example illustrated, the blade 20 consists of an extension of the outer side face of the bottom 27, in such a manner as to form a vertical wall 31 oriented in a plane at right angles to the plane of the distributor wheel 20. This vertical wall 31 is therefore disposed downstream of the aperture 24 and forms a cavity 32 behind said end 22*b*.

Inside this cavity 32 is mounted a first deflector 33 formed by a small independent plate applied against the vertical wall 31. The top part of this first deflector 33 is in the form of a triangle whose apex 33*a* is directed upwards and projects above the the vertical wall 31.

In addition, a second deflector 34 formed by a small independent plate is mounted inside the cavity 32, this second deflector 34 being disposed back to back with the first deflector 33. The top part of this second deflector 34 is likewise in the form of a triangle, whose apex 34*a* is directed upwards and has height less than that of the apex 33*a* of the first deflector.

Figure 3:
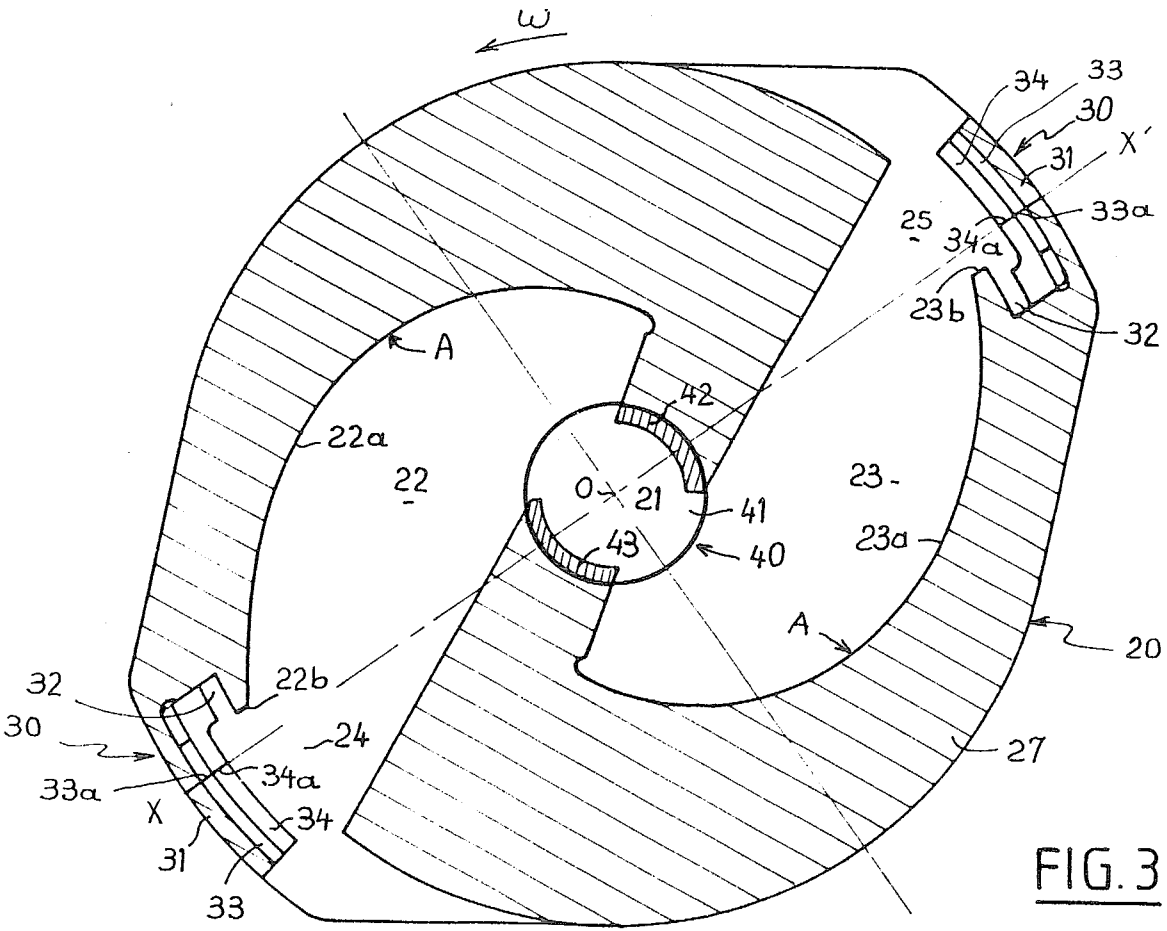
FIG. 3 is a view in section along line III—III in FIG. 2.
Figure 4:
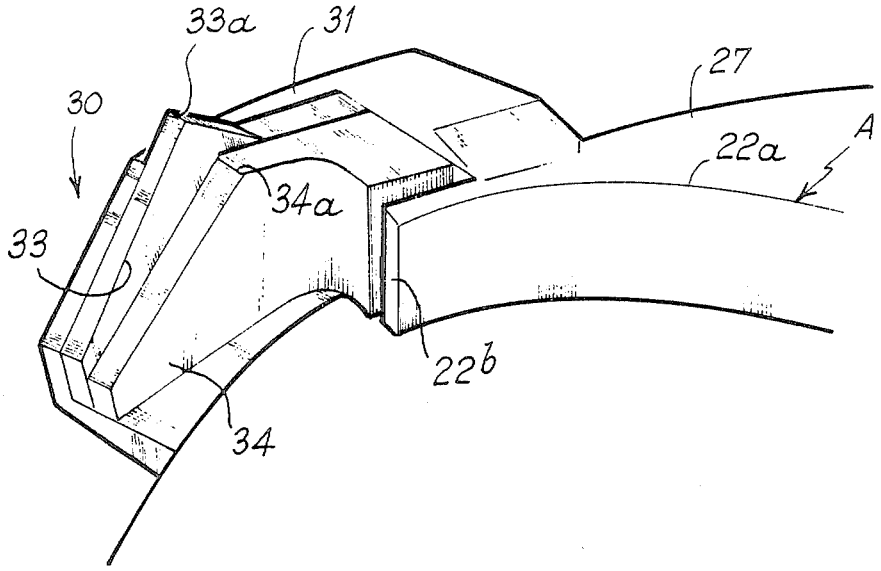
FIG. 4 is a view in perspective of a blade disposed at each ejection aperture of the distributor wheel.

In the example illustrated, the side faces of the two deflectors 33 and 34 have a curvature determined in such a manner that the center of these curvatures coincides with the center 0 of the distributor wheel 20 on the axis of rotation. Furthermore, in horizontal projection in a horizontal plane of the wheel 20, the apices 33*a* and 34*a* of the respective deflectors 33 and 34 are disposed on the same radius OX passing through the center 0 of the wheel 20, as can be seen in FIG. 3.

The side faces of the two deflectors 33 and 34 may also have a plane shape and be perpendicular to the radius OX.

The blade 30 disposed at the outlet of the channel 23 is identical to the blade disposed at the outlet of the channel 22.

In cases where the distributor wheel 20 has two opposite, symmetrical channels 22 and 23, the apices 33*a* and 34*a* of the deflectors 33 and 34 of each blade are situated on the same diameter XOX' of said wheel 20.

Moreover, the distributor wheel 20 comprises means 40 (FIG. 2) for adjusting the starting point of the stable self-protection layer 28 formed by the particles in each channel 22 and 23. These means 40 are composed of a disc 41 fixed for rotation with the bottom 27 and disposed in the axis of the wheel 20 under the feed chamber 21. This disc 41 is provided on its top face with small raised studs (42, 43, . . . ) in the shape of sectors of a circular crown.

The number of small studs corresponds to the number of channels provided in the distributor wheel 20. In the example illustrated, the distributor wheel 20 is provided with symmetrical channels, so that the disc 41 has two small studs 42 and 43 diametrically opposite one another, the small stud 42 corresponding to the channel 22 and the small stud 43 corresponding to the channel 23.

The disc 41 is adjustable in position in such a manner as to change the position of the small studs 42 and 43 in relation to the inlet of the channels 22 and 23, thus making it possible to adjust the starting point of the self-protection layer in each channel in accordance with the particle size of the material to be treated and the coefficients of friction of the materials in contact.

As has previously been indicated, in the course of the operation of the grinder, a heap 28 of particles forms in each of the channels 22 and 23 until this heap defines a curve B in such a manner that this fixed curve of particles constitutes effective protection for the guide faces.

The particles introduced into the feed chamber 21 likewise form, in the course of the operation of the grinder, a sloping heap 50 of particles on the second deflector 34 of each blade 30, extending the curve B of the layer 28. The length of this heap 50 depends on the length of the second deflector 34, which is determined in such a manner that the thickness of the self-protection layer of particles at the end **22*b*, 23*b* of each channel 22, 23** will be sufficient to prevent wear on said end.

Figure 6:
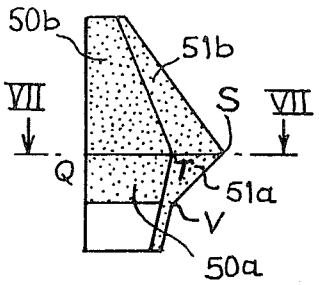
FIG. 6 is a front view of the ejection blade in the direction of the arrow F in FIG. 5.
Figure 7:
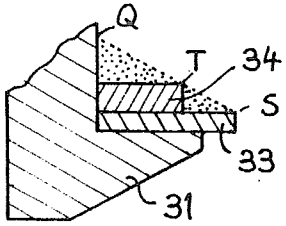
FIG. 7 is a view in section along line VII—VII in FIG. 6.

Because of the triangular shape of the second deflector, the heap 50 has the shape of an upwardly inclined dihedron defining two half-planes **50*a* and 50*b* of intersection QT (FIG. 6**).

Above the slope 50 there is likewise formed on the first deflector 33 a second sloping heap 51 of particles. Because of the triangular shape of the deflector 33, the heap 51 has the shape of an upwardly inclined dihedron defining two half-planes **51*a* and 51*b* of intersection TS. The half-plane TSV of the dihedron 51 defines a boundary layer in such a manner that the component of its normal in a projection in the plane of the wheel 20** will be in a direction substantially opposite to the direction of rotation w of said wheel.

After the formation of the protective layer 28 in each channel 22, 23 and the formation of the sloping heaps 50 and 51 on the deflectors 33 and 34 of each blade 30, the particles of material to be treated which are introduced through the feed chamber 21 of the distributor wheel 20 will be brought into motion and will first slide over the cushion of particles held captive between the curves A and B.

When the particles arrive in the half-plane **50*a* of the heap 50**, these particles will be arrested because of the shape of said heap, will change level and assume the direction OX, thus making it possible to avoid direct ejection of these particles.

The particles then arrive at the level of the point T on the half-plane TSV of the heap 51. In view of the fact that the component of the normal of the half-plane TSV in projection in the plane of the wheel 20 is in a direction substantially opposite to the direction of rotation of said wheel, the contact force between the particles and the wheel in the half-plane TSV is eliminated and the particles leave the wheel, which does not give rise to wear on those parts.

In addition, the speed of entrainment of the particles resulting from the rotation of the distributor wheel 20 being substantially greater than the relative speed of said particles in the plane TSV, this relative speed is therefore negligible in relation to said speed of entrainment, so that at the outlet of the plane TSV the particles resume a horizontal trajectory and are thrown onto the target 8.

Depending on the nature of the product to be thrown and on the particle size of the product which it is desired to obtain, the distributor wheel 20 must turn at a higher or lower speed. However, in all cases a protective cushion will be formed, because the adhesion of the particles is independent of the speed of rotation of the wheel.

Self-protection of the channels, of the end of the channels at the outlet aperture, and of the blade is thus achieved with the aid of the product itself, thus avoiding any occurrence of abrasion, while retaining a speed of rotation of the distributor wheel sufficiently high to obtain the desired particle size.

Furthermore, depending on the coefficient of friction of the materials in contact, and also on the particle size of the material to be treated, it is possible to modify the position of the small studs 42 and 43 by turning the disc 41 in one direction or the other, so as to change the starting point of the layer 28 in the channels 22 and 23 in such a manner as to obtain a determined position of the starting point Q and to form, at the ends **22*b*, 23*b*** of the channels, a protective cushion suitable for avoiding all wear.

Finally, the deflectors 33 and 34 of the blades 30 can be mounted for transverse and/or vertical adjustment in order to enable the geometry of the heaps 50 and 51 and the position of the radius OX and/or OX' in relation to the ends **22*b*, 23*b* of the channels 22 and 23** to be modified in accordance with the coefficients of friction of the materials in contact and the particle size of the material to be treated.

The deflectors 33 and 34 are easy to replace and may, for example, be made of very hard, abrasion resistant material.

Instead of using blades comprising two independent deflectors, these two deflectors may in fact be made in one piece. It is also possible to provide blades fastened to the cover 26 of the wheel instead of to the bottom 27, and it is possible for the apices **33*a* and 34*a* of the deflectors 33 and 34 to be directed downwards, in which case the particles will be ejected underneath the distributor wheel 20**. This arrangement provides advantages. There will in fact be no risk of the ground particles falling back onto the cover and consequently giving rise to abnormal rapid wear of the cover and of the periphery of the wheel.

What is claimed is:

1. A disctributor wheel for a vacuum projection grinder and to be driven rotationally for the projection at high speed of a granular material onto a target (8), said wheel comprising a cover (26) and a bottom (27) between which are provided a feed chamber (21) and a plurality of channels (22, 23) oriented in a direction perpendicular to the axis of said wheel (20) and leading outward via outlet apertures (24, 25), guide faces (**22*a*, 23*a*) of said channels each having a curve A whose contour is calculated, in accordance with the coefficients of friction of the materials in contact, to effect the attachment on said curve A of a stable selfprotection layer (29) consisting of the particles themselves, said wheel further comprising, downstream of each outlet aperture (24, 25) of the channels, a member (30, 33, 34) fixed for rotation with said wheel (20) and making it possible to form, at the end (22*b*, 23*b*) of the guide face (22*a*, 23*a*) of each channel (22, 23**), a protective cushion composed of the particles themselves and extending the stable self-protection layer (28), and to eliminate the contact force between the particles and the wheel (20) before the ejection and projection of said particles onto the target (8).

2. A wheel as claimed in claim 1, in which the member (30, 33, 34) disposed downstream of each outlet aperture (24, 25) of the channels (22, 23) consists of a blade (30) at right angles to the plane of the wheel (20) and provided with means (33, 34) effecting, beyond the end (22*b*, 23*b*) of the guide face (22*a*, 23*a*) of each channel (22, 23), the formation of self-protection slopes (50, 51) which are composed of the particles themselves and whose geometry and inclination are determined in dependence on the coefficient of friction of the materials in contact and on the particle size of the material being treated.

3. A wheel as claimed in claim 2, in which the means on the blade (30) for forming slopes (50,51) are composed of two juxtaposed deflectors (33, 34) of triangular shape and of different heights.

4. A wheel as claimed in claim 3, in which in projection in the plane of the distributor wheel (20) the apices (33*a*, 34*a*) of the respective triangular deflectors (33, 34) are on the same radius OX passing through the center 0 of said wheel and situated downstream of the end (22*b*, 23*b*) of the guide face (221, 23*a*) of each channel (22, 23) in relation to the direction followed by the particles inside the distributor wheel (20).

5. A wheel as claimed in claim 3, in which the side faces of the triangular deflectors (33, 34) have a determined curvature the center of which coincides with the center 0 of the distributor wheel (20) on the axis of rotation.

6. A wheel as claimed in claims 3 or 4, in which the side faces of the triangular deflectors (33, 34) are plane in shape and are at right angles to the radius of the distributor wheel passing through the apices (33*a*, 34*a*) of said deflectors.

7. A wheel as claimed in claim 3, in which the slopes of particles (50, 51) formed by the two deflectors (33, 34) are situated above one another and both are in the form of a dihedron respectively defining two half-planes (50*a*, 50*b*; 51*a*, 51*b*) whose respective intersections QT and TS are situated in a plane at right angles to the plane of the distributor wheel (20) and passing through the apices (33*a*, 34*a*) of two triangular deflectors (33, 34).

8. A wheel as claimed in claim 7, in which the half-plane (51*a*) of the slope (51) defines a stable boundary layer of particles whose component of its normal in projection in the plane of the distributor wheel (20) is in a direction substantially opposite to the direction of rotation of said wheel.

9. A wheel as claimed in claim 2, in which the blade (30) is integral with or fastened to the bottom (27) of the distributor wheel (20) and the apices (33*a*, 34*a*) of the deflectors (33, 34) are directed upwards in relation to the plane of said wheel.

10. Wheel according in claim 2, in which the blade (30) is integral with or fastened to the cover (26) of the distributor wheel (20) and the apices (33*a*, 34*a*) of the deflectors (33, 34) are directed downwards in relation to the plane of said wheel.

11. Wheel according in claim 3, in which transverse and/or vertical position of the deflectors (33, 34) is adjustable in accordance with the particle size of the material to be treated.

12. Wheel according to claim 1, in which distributor wheel (20) is provided with means (40) for adjusting the starting point of the stable self-protection layer (28) formed by the particles in each channel (22, 23) in dependence on the coefficients of friction of the materials in contact and on the particle size of the material to be treated.

13. Wheel according to claim 12, in which the means (40) consist of a disc (41) fixed for rotation with the distributor wheel (20) and situated in the axis of said wheel below the feed chamber (21), said disc (42) being provided on its upper face with small raised studs (42, 43, . . . ) in the shape of sectors of a circular crown.

* * * * *